US006471079B2

(12) United States Patent
Berlingieri

(10) Patent No.: US 6,471,079 B2
(45) Date of Patent: Oct. 29, 2002

(54) MULTI PEG ADAPTER DEVICE

(76) Inventor: Alfredo Berlingieri, 3999 de la Duchesse, Laval (CA), H7E 5H5

( * ) Notice: Subject to any disclaimer, the term of this patent is extended or adjusted under 35 U.S.C. 154(b) by 0 days.

(21) Appl. No.: 09/819,755

(22) Filed: Mar. 29, 2001

(65) Prior Publication Data

US 2001/0047974 A1 Dec. 6, 2001

Related U.S. Application Data

(60) Provisional application No. 60/194,368, filed on Apr. 4, 2000.

(51) Int. Cl.[7] ..... A47H 1/08
(52) U.S. Cl. ..... 211/105.3
(58) Field of Search ..... 211/105.3, 103, 211/106, 175, 57.1, 59.1; 248/220.41, 220.31, 220.43

(56) References Cited

U.S. PATENT DOCUMENTS 596,380 A * 12/1897 Pursley
3,606,711 A * 9/1971 Lodato
5,303,830 A * 4/1994 Metcalf
5,690,238 A * 11/1997 Schmehr
6,193,079 B1 * 2/2001 Wiemer
6,234,330 B1 * 5/2001 Gray

* cited by examiner

*Primary Examiner*—Alvin Chin-Shue
*Assistant Examiner*—Sarah Purol

(57) ABSTRACT

A multi peg adapter device for providing increased display space beyond standard shelving devices. An elongated crossbar releasably supports a plurality of commercially available peg holders and of adjustable length is provided to allow the product user to regulate the length of the multi peg adapter device to its preferred use. The device further has stabilizer engaging plates at both ends to releasably engage one of the notches of the support arms so as to allow the multi peg adapter device to be secured to standard wall securing structure. Moreover the multi peg adapter device has vertical stoppers longitudinally spaced at equal intervals on the crossbar to prevent the peg holders from sliding along the crossbar.

15 Claims, 4 Drawing Sheets

MULTI PEG ADAPTER DEVICE

CROSS REFERENCE TO RELATED APPLICATION

This application is related to U.S. provisional application for patent No. 60/194,368 filed on Apr. 4, 2000.

FIELD OF THE INVENTION

The present invention relates to a peg adapter device and more specifically to a peg adapter device adapted to fixedly support to plurality of peg holders and to prop up and advantageously display merchandise in a store.

BACKGROUND OF THE INVENTION

In the modern retail market, competition is fierce among merchants. With ever increasing quantities of merchandise to display, these merchants frequently face article storage and display space limitations. To survive, they must overcome limited shelving space and incorporate an unlimited variety of new products into their display units. They must also face intense competition for the consumers' interest as well emerging technologies such as the internet retail market. There is a constant demand in the industry for new improved methods of displaying a greater number of products especially if the new product is easy to assemble, cost effective and provides a greater ease for the loading of the stock on the shelving unit.

Various types of shelving units already exist and are commonly used in today's retail stores. Although the shelving units are quite versatile on a horizontal plane there are limitations in the existing assemblies in that the displays are limited in depth of the vertical plane. To illustrate, if a narrow assembly is used to hold the retail product attached to the display wall; there is a significant amount of retail space lost in front of this assembly. This lost space could be advantageously used to prop up more salable products without visually or physically disturbing access to the more inwardly (or in-depth) displayed goods. Similarly, most prop up devices currently in use do not give access storing space behind the display assembly.

Peg adapter devices currently in use by retailers to display retail goods are not generally mounted in a fixed position and are frequently horizontally laterally slideable. (Most systems use some form of rail structure which does not restrict the lateral displacement of the peg devices). This method of display is limited in that the retailers have to frequently adjust the pegs and goods on display. This is neither time nor cost effective. There is a real demand for a peg retaining device that could effectively retain the pegs without any horizontal displacement but would still allow the easy loading and removal of sellable goods.

OBJECTS OF THE INVENTION

It is a general object of the present invention to provide a multi peg adapter device that obviates the above noted disadvantages.

It is another object of the present invention to provide a multi peg adapter device that can be selectively positioned forwardly to another display assembly or to an empty space to make selective room for product display.

It is a further object of the present invention to provide a multi peg adapter device that provides fixed attachment points for the different pegs/peg holders.

It is yet another object of the present invention to provide a multi peg adapter device that has an adjustable length.

It is yet another object of the present invention to provide a multi peg adapter device that is versatile, easy to use and manufacture.

An advantage of the present invention is that it helps retail merchants to easily change, reorganize, modify and improve the way their merchandise is displayed.

Other objects and advantages of the present invention will become apparent from a careful reading of the detailed description provided herein, with appropriate reference to the accompanying drawings.

SUMMARY OF THE INVENTION

According to an aspect of the present invention, there is provided a multi peg supporting adapter for supporting a generally elongated peg, the multi peg supporting adapter being mountable to an anchoring structure attached to a wall, the anchoring structure including attachment apertures formed therein, the peg defining a peg longitudinal axis, a peg first end and an opposed peg second end, the multi peg supporting adapter comprises:

- a supporting bracket, the supporting bracket having a generally elongated configuration defining a bracket longitudinal axis, a bracket first end and a generally opposed bracket second end, the bracket first end being provided with a bracket releasable mounting means for releasably anchoring the bracket first end to the anchoring structure so that the bracket is cantilevered relative to the anchoring structure with the bracket second end positioned away from the anchoring structure;
- a generally elongated supporting rod, the supporting rod defining a rod longitudinal axis, a rod first end and an opposed rod second end;
- a rod-to-bracket releasable attachment means for releasably attaching the rod first end to the supporting bracket so that the rod longitudinal axis extends in a generally perpendicular relationship relative to the bracket longitudinal axis; the rod-to-bracket releasable attachment means allowing the rod first end to be attached to the supporting bracket at predetermined attachment locations positioned along the supporting bracket between the bracket first and second ends;
- a peg-to-rod releasable attachment means for releasably attaching the peg first end to the supporting rod so that the peg longitudinal axis extends in a generally perpendicular relationship relative to the rod longitudinal axis, the peg-to-rod releasable attachment means allowing for the peg first end to be attached to the supporting rod at predetermined attachment locations positioned along the supporting rod between the rod first and second ends.

Preferably, the supporting rod has telescoping rod segments for allowing telescopic length adjustment of the supporting rod.

Preferably, the supporting bracket has a generally flat configuration defining a pair of opposed bracket surfaces, the bracket also defining a bracket attachment edge;

the rod-to-bracket releasable attachment means including at least two attachment notches spaced along the bracket attachment edge and an attachment leg extending from the rod first end, the attachment leg being configured and sized for being at least partially insertable into the attachment notches and retractable therefrom, wherein when the attachment leg is at least partially inserted into a corresponding attachment notch the attachment leg is also releasably secured thereto.

Preferably, each of the attachment notches defines a notch first edge extending inwardly and generally perpendicularly to the bracket attachment edge into the supporting bracket; each of the attachment notches also defining a notch second edge intercepting the notch first edge and extending in a direction generally parallel to bracket attachment edge; each of the attachment notches further defining a notch third edge, the notch third edge extending at an angle between the notch second edge and the bracket attachment edge.

Preferably, the attachment leg includes a leg spacing segment and a leg attachment segment, the leg spacing segment extending between the rod first end and the leg attachment segment; the leg attachment segment having a generally U-shaped cross-sectional configuration defining a pair of spaced apart abutment plates, the leg attachment segment being at least partially insertable into one of the attachment notches with each of the abutment plates abutting against a corresponding one of the bracket surfaces.

Preferably, the anchoring structure includes an anchoring pilaster. attachable in a generally vertical orientation to the wall, the anchoring pilaster having a generally U-shaped cross-sectional configuration defining a pair of pilaster spacing segments maintained in a spaced apart and generally perpendicular relationship relative to each other by a pilaster anchoring segment, the attachment apertures having a generally slot-shaped configuration;

the bracket releasable mounting means including a bracket anchoring hook extending from the bracket first end, the bracket anchoring hook being provided for inserting and releasably anchoring into one of the attachment apertures.

Alternatively, the anchoring structure includes pegboard attachable in a generally parallel relationship to the wall, the attachment apertures having a generally disk-shaped configuration;

the bracket releasable mounting means including a bracket-peg hook extending from the bracket first end, the bracket-peg hook being provided for inserting and releasably anchoring into one of the attachment apertures.

Preferably, the supporting rod includes a rod core and a rod sleeve slidably mounted thereon for telescopic movement relative thereto, the peg-to-rod releasable attachment means including at least two attachment rods attached to the supporting rod and extending in a direction generally parallel to the latter, the attachment rods being in a spaced apart relationship relative to each other so as to define an attachment rod spacing therebetween, the attachment rod spacing being configured and sized for releasably receiving an attachment section of the peg first end.

Preferably, the peg-to-rod releasable attachment means includes a stopper member attached to the attachment rods for preventing sliding movement of the peg relative to supporting rod along the longitudinal axis.

According to another aspect of the present invention, there is provided a multi peg supporting adapter for supporting a generally elongated peg, the multi peg supporting adapter being mountable to an anchoring structure attached to a wall, the anchoring structure including attachment apertures formed therein, the peg defining a peg longitudinal axis, a peg first end and an opposed peg second end, the multi peg supporting adapter comprises:

a pair of supporting brackets, each of the supporting brackets having a generally elongated configuration defining a bracket longitudinal axis, a bracket first end and a generally opposed bracket second end, the bracket first end being provided with a bracket releasable mounting means for releasably anchoring the bracket first end to the anchoring structure so that the bracket is cantilevered relative to the anchoring structure with the bracket second end positioned away from the anchoring structure;

a generally elongated supporting rod, the supporting rod defining a rod longitudinal axis, a rod first end and an opposed rod second end;

a rod-to-bracket releasable attachment means for releasably attaching the rod first and second ends to a corresponding one of the supporting brackets so that the rod longitudinal axis extends in a generally perpendicular relationship relative to the bracket longitudinal axis; the rod-to-bracket releasable attachment means allowing the rod first and second ends to be respectively attached to the corresponding one of the supporting brackets at predetermined attachment locations positioned along the supporting brackets between the bracket first and second ends;

a peg-to-rod releasable attachment means for releasably attaching the peg first end to the supporting rod so that the peg longitudinal axis extends in a generally perpendicular relationship relative to the rod longitudinal axis, the pegto-rod releasable attachment means allowing for the peg first end to be attached to the supporting rod at predetermined attachment locations positioned along the supporting rod between the rod first and second ends.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawing the preferred embodiments of the present invention will be herein described for indicative purposes and by no means as of limitation.

Figure 1:
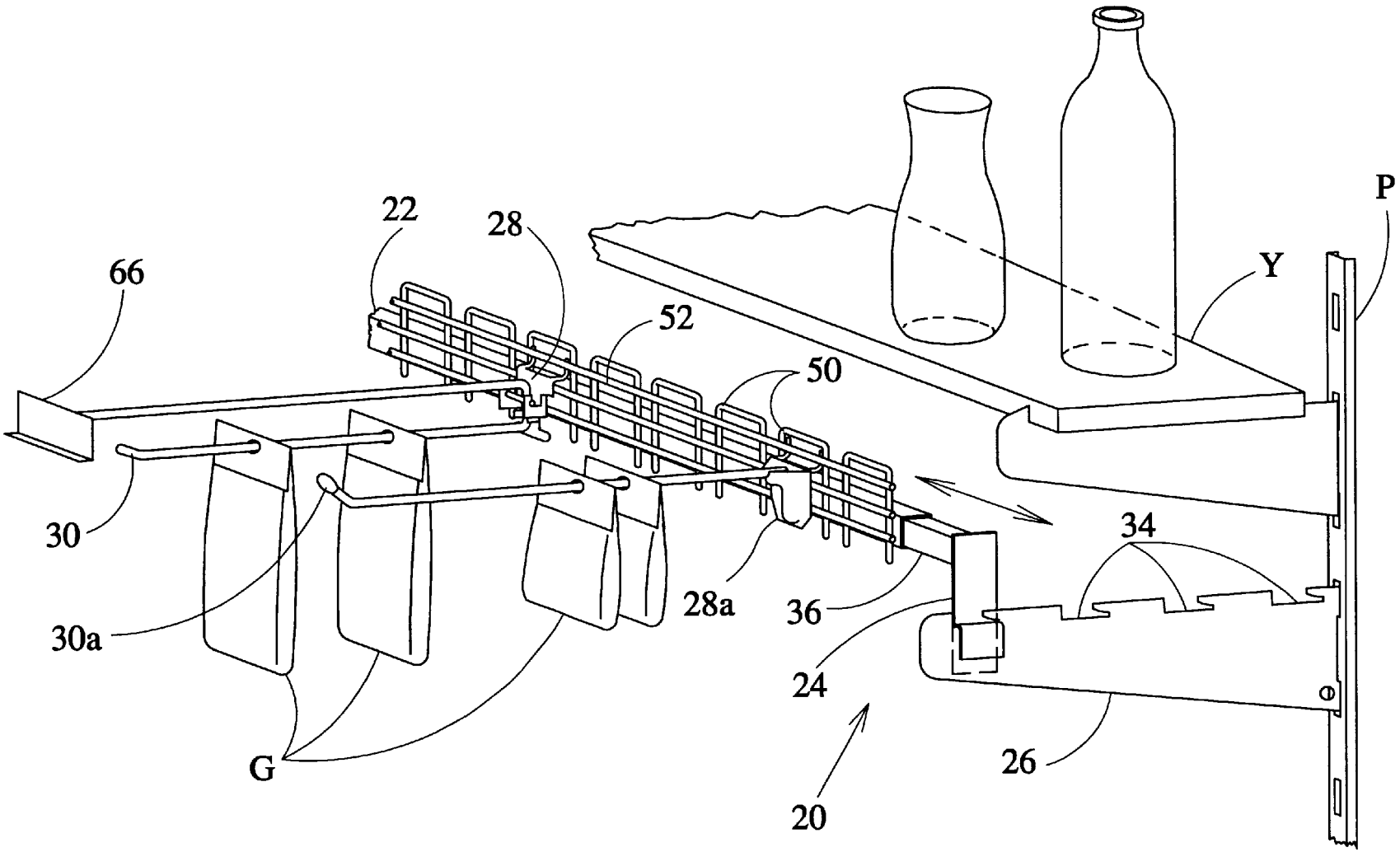
FIG. 1 is a perspective view of an embodiment of a multi peg adapter device according to the present invention, showing peg holders mounted thereon.

Referring to FIG. 1, there is shown an embodiment 20 of a multi peg adapter device according to the present invention mounted on a wall securing or anchoring structure such as a pair of holding posts P mounted on a wall (not shown). The device 20 includes an elongated crossbar member 22, or supporting rod, with two (2) ends, preferably stabilizer engaging plate members 24, or rod-to-bracket attachment means, supported by cantilevered support arm members 26, or supporting brackets. The crossbar 22 is adapted for releasably supporting a plurality of display pegs comprised of peg holders 28, 28*a*, or peg attachment section, coupled with respective pegs 30, 30*a*. Various goods G, generally packaged, are hung on the pegs 30, 30*a*. A standard horizontal display Y is also mounted on the same holding posts P. It is shown that the standard display Y is located behind the adapter device 20, relatively to a vertical plane generally perpendicular to the direction the support arms 26. This characteristic of the device 20 to be able to display goods G in such a forward position offers one of the main advantages of this invention. As shown, space is valuably used permitting to display a second row of wares while the merchandise held on the display Y remain as visually and physically accessible to the retail shopper.

Figure 2:
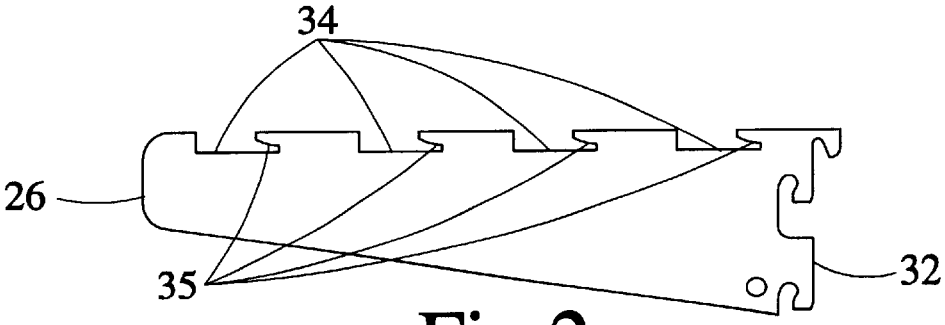
FIG. 2 is a side view of a support arm of the embodiment of FIG. 1.
Figure 3:
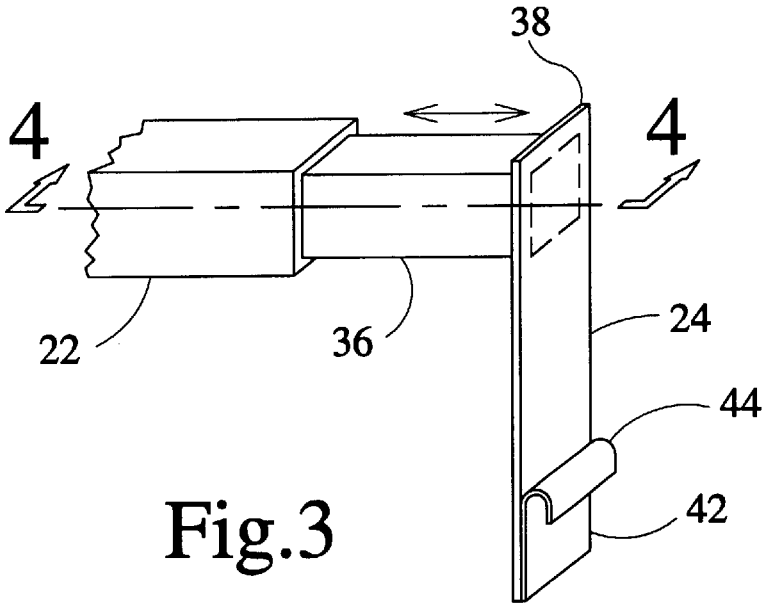
FIG. 3 is an enlarged front perspective view of an extension member of the embodiment of FIG. 1 secured to an upper extremity of a stabilizer engaging plate.
Figure 4:
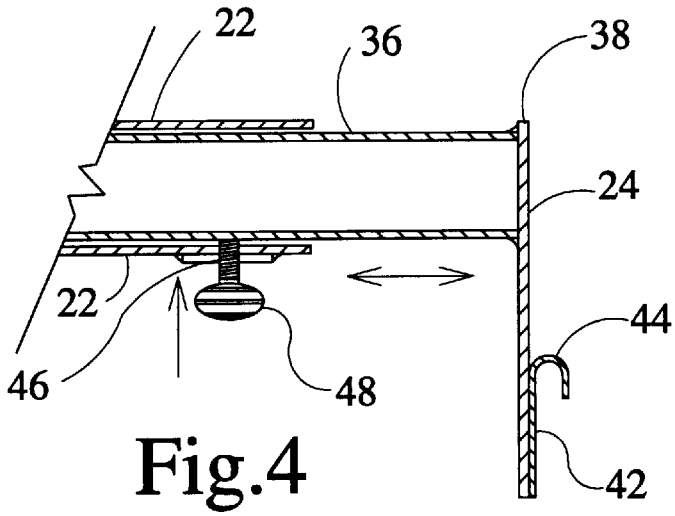
FIG. 4 is a section view taken along line 4—4 of FIG. 3.

FIG. 2 shows one of the support arms 26. Each support arm 26 is a generally flat, elongated rectangular plate and is generally horizontally oriented. One of the shorter sides of the support arm 26 is a post holding end 32, or arm mounting means, adapted to be removably and rigidly fixed onto a standard holding post P (shown on FIG. 1), to apertures formed therein, as is well known in the art. A plurality of cutout attachment notches 34 are located along the top long side, or bracket attachment edge, of the support arms 22 to be releasably engaged by the stabilizer engaging plates 24, or attachment legs. in order to be adjustable in length for fitting the variable distance between two holding posts P and different displays Y, the crossbar 22 has an extension member, preferably telescopic, with an inner sliding member 36, or rod core, protruding out of one open end of the crossbar 22, or, rod sleeve. Preferably, both crossbar 22 and sliding member 36 are of square cross-section, as illustrated in FIGS. 3 and 4. The closed end of crossbar 22 and the exposed outer extremity of sliding member 36 are provided with a stabilizer engaging plate 24 that is preferably vertically oriented as to clear any display Y that could run underneath the crossbar 22. Each stabilizer engaging plate 24 is preferably flat and rectangular and has the inside of its upper end 38, or leg spacing segment, secured, preferably by welding, on the its respective end, of sliding member 36 or crossbar 22. The outside of the lower end 40, or leg attachment segment, of the stabilizer engaging plate 24 is secured, preferably by welding, to a flange 42. The top portion of the flange 42 has an outwardly protruding overhanging end 44 such as a downwardly oriented hook with a generally U-shaped cross-sectional configuration. This hook 44 releasably engages one of the cutout notches 34 of the support arm 26 (shown on FIGS. 1 and 2). Preferably, each cutout notch 34 is provided with a bottom edge (or second edge) backwardly oriented extension 35 adapted to slidably receive a portion the hook 44 of the flange 42 for securing and stabilizing the latter therein.

A small threaded aperture 46 is radially located at the periphery of the crossbar 22 in proximity to the open end the inner sliding extension 36 is inserted in. The threaded aperture 48 receives a securing member, preferably a clamping screw 48, used to abut against the inner sliding member 36 and rigidly secure the latter in place, thus preventing it from moving relative to the crossbar 22 once in the desired position.

Figure 5:
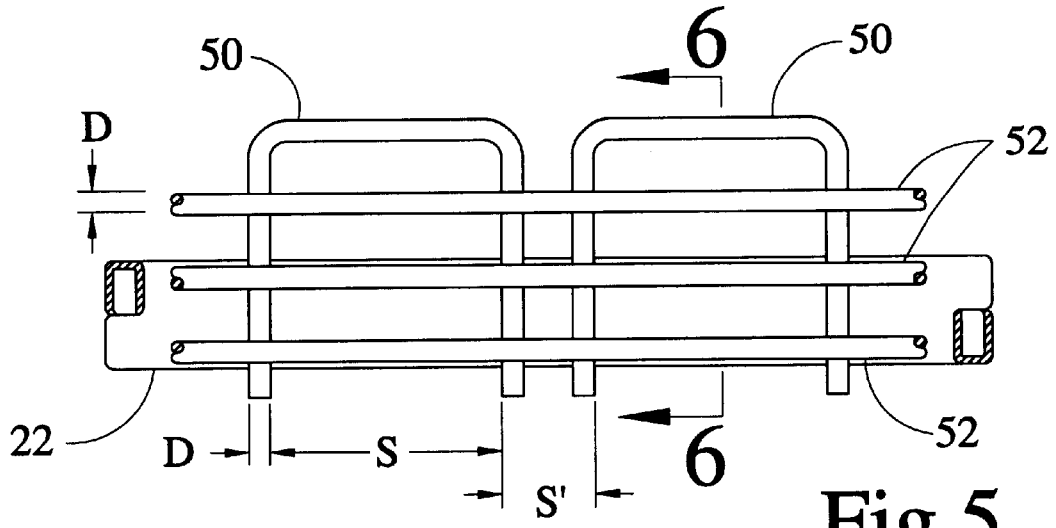
FIG. 5 is an enlarged partial front view of the crossbar of the embodiment of FIG. 1.
Figure 6:
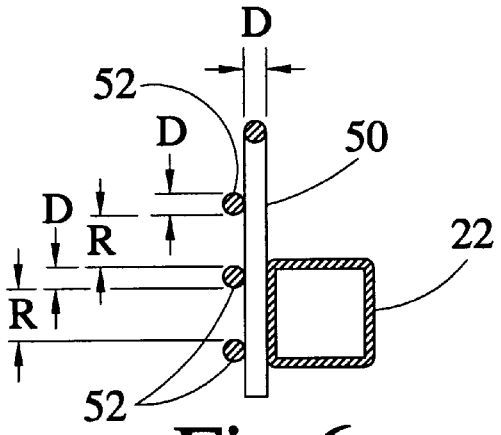
FIG. 6 is a section view taken along line 6—6 of FIG. 5.

FIGS. 5 and 6 show a partial middle section of the crossbar 22. A plurality of U-shaped stopper members 50 are secured, preferably by welding, into an up-sidedown, or reversed, position with their two legs of the U-shape being essentially vertical and below the top web, onto the crossbar 22. Each stopper 50 is preferably formed out of circular rods, of a diameter D. Adjacent U-shaped stoppers 50 are longitudinally, preferably equally, spaced along the elongated crossbar 22 by a minimal distance S' while the distance between the two legs of each U-shaped stopper 50 is approximately of the distance S. At least two (2), preferably three (3), horizontal attachment rods 52, forming a peg-to-rod attachment means, are secured, preferably by welding, to the U-shaped stoppers 50. Each horizontal rod 52 is thereby elongated and parallel to the crossbar 22. The vertical distance between adjacent horizontal rods 52 is R. The space between the horizontal rods 52 and the crossbar 22 is the diameter D of all reversed U-shaped stoppers 50. Preferably, the diameter of horizontal rods 52 is also approximately D.

Figure 5A:
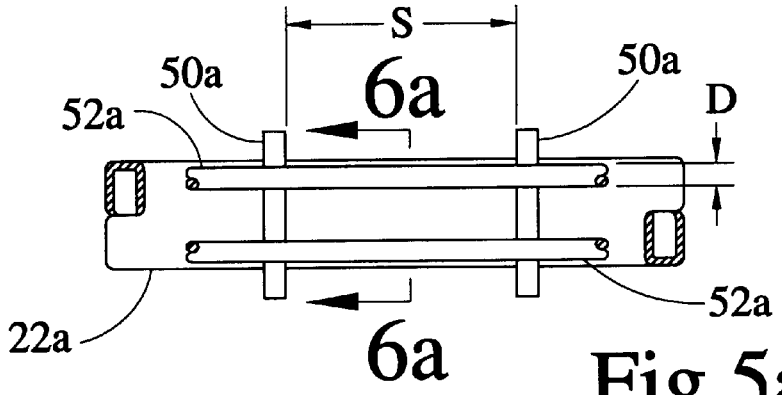
FIG. 5*a* is a view similar of FIG. 5 showing a second embodiment of the crossbar.
Figure 6A:
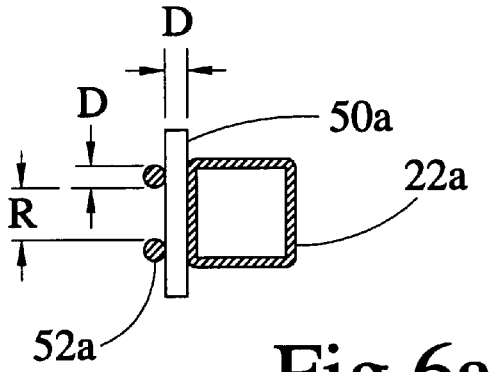
FIG. 6*a* is a section view taken along line 6*a*–6*a* of FIG. 5*a*.

FIGS. 5*a* and 6*a* show a partial middle section of a second embodiment the crossbar 22*a*. A plurality of vertical stoppers 50*a* are secured, preferably by welding, in vertical alignment on one side of the crossbar 22*a*. The vertical stoppers 50*a* are elongated and preferably short circular rods, of a diameter D. All horizontal stoppers 50*a* are longitudinally, preferably equally, spaced along the elongated crossbar 22*a* by a distance S separating adjacent stoppers 50*a*. At least two (2) horizontal rods 52*a* are secured, preferably by welding, on a plurality of horizontal stoppers 50*a*. Each horizontal rod 52*a* is thereby elongated and parallel to the crossbar 22*a*. The vertical distance between adjacent horizontal rods 52*a* is R. The space between the horizontal rods 52*a* and the crossbar 22*a* is the diameter D of vertical stoppers 50*a*. Preferably, the diameter of horizontal rods 52*a* is also approximately D.

Figure 7:
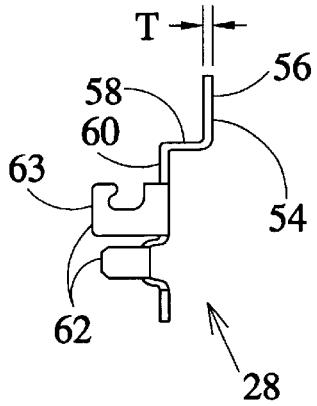
FIGS. 7, 8 and 9 are side, front and top plan views of a peg holder to be mounted on the crossbar of the embodiment of FIG. 1.
Figure 8:
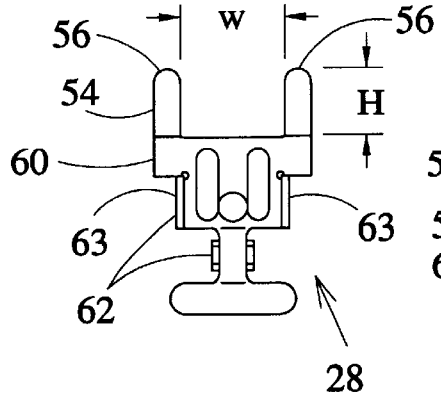
Figure 9:
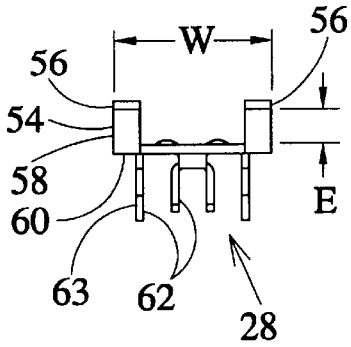

FIGS. 7, 8 and 9 show the standard peg holder, as known in the industry. The peg holder 28 is preferably formed out of a generally flat material of uniform thickness T. The peg holder 28 includes a generally vertical flat main section 60 with two adjacent backwardly protruding L-shaped ears 54 secured to its top portion. The two L-shaped ears 54 are parallel and separated by a distance w and provide an overall width W to the peg holder 28. The vertical upper part 56 of each L-shaped ear 54 is of a height H and upwardly extends from its corresponding horizontal lower part 58, itself of a depth E and backwardly extending from the main section 60. A holding section 62, formed of two lateral arms 63, forwardly extends from the main section 60. The L-shaped ears 54 are adapted to be inserted in-between two adjacent horizontal rods 52, 52*a*. The distance R between the two adjacent rods 52, 52*a* is sufficient to allow for a smooth passage of the ears 54 therethrough (FIGS. 5, 5*a*, 6 and 6*a*). The upper parts 56 of the L-shaped ears 54 are adapted to be positioned between the upper horizontal rod 52, 52*a* and the crossbar 22, 22*a*. Also to allow for the smooth passage, the thickness T of the upper parts 56 of the L-shaped ears 54 shall be relatively smaller than the diameter D of the stoppers 50, 50*a*. The depth E is generally equal to or slightly larger than the diameter D of the horizontal rods 52, 52*a*. The height H shall be enough to permit the upper parts. 56 to abut on the upper back of the horizontal rod 52, 52*a* while the lower parts 58 rest on the lower horizontal rod 52, 52*a*. Most of the main section 60 abuts on the front of at least the first lower horizontal rod 52, 52*a*. Thus, when the peg holder 28 is inserted in-between the two horizontal rods 52, 52*a* it is rigidly but releasably secured in the vertical plane. For the embodiment of the FIGS. 5 and 6, the distance S is preferably slightly larger than the distance W between the two legs of the stoppers 50. Similarly, the distance S' in-between two adjacent stoppers 50 is preferably slightly smaller than the distance w, hence permitting a positioning of the peg holder 28 not only in-between the two legs of a same U-shaped stopper 50 but also overlapping two adjacent legs of two adjacent U-shaped stoppers 50. Furthermore in the second embodiment of FIGS. 5*a* and 6*a*, when the peg holder 28 is inserted in-between the two horizontal rods 52, 52*a*, the peg holder 28 is also positioned to have its two L-shaped ears 54 between two horizontal stoppers 50*a*. Again, the distance S is preferably slightly larger than the distance W, and S' slightly smaller than w. Thus, when the peg holder 28 is inserted in-between the two horizontal rods 52, 52*a* and between the vertical stoppers 50*a*, or in-between or overlapping the legs of the U-shaped stoppers 50, it is rigidly but releasably secured within the vertical plane; the peg holder 28 is then vertically secured between rods 52, 52*a* and horizontally secured along the direction of the crossbar 22, 22*a* by the stoppers 50, 50*a*. It is also perpendicularly secured to the vertical plane by the rods 52, 52*a*.

Figure 7A:
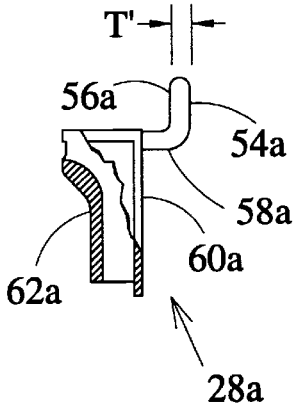
FIGS. 7*a*, 8*a* and 9*a* are views similar to FIGS. 7, 8 and 9 respectively, showing a second type of peg holder to be mounted on the crossbar of the embodiment of FIG. 1.
Figure 8A:
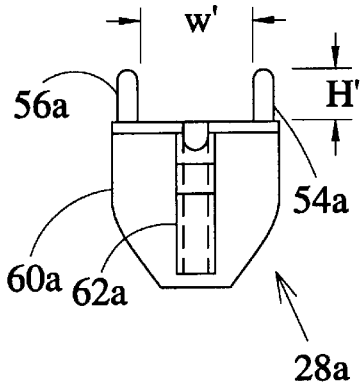
Figure 9A:
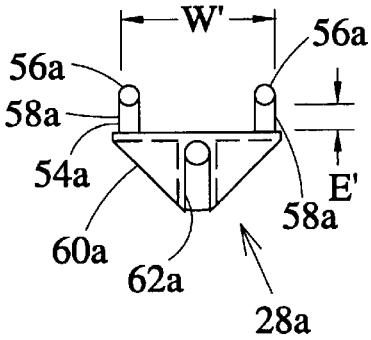

FIGS. 7*a*, 8*a* and 9*a* show another type of standard peg holder 28*a*. The peg holder 28*a* has similar elements 54*a*, 56*a*, 58*a*, 60*a* and 62*a* and characteristics T', w', W', H', E' to the peg holder 28 presented in FIGS. 7, 8, and 9 with the only noticeable difference of a slightly modified holding section 62*a* for the reason explained here after.

Figure 10:
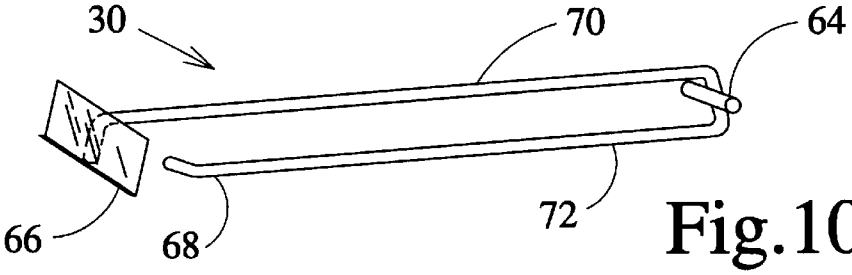
FIGS. 10 and 10*a* are perspective views of pegs adapted to engage the peg holders of FIGS. 7 and 7*a* respectively.

FIG. 10 shows a standard elongated peg 30 adapted to engage peg holder 28. The peg 30 includes a horizontal support section 72 having. a back peg engaging extremity 64 and a free front extremity 68. The peg engaging extremity 64 preferably includes a generally vertical portion adapted to abut the main section 60 of the peg holder 28, and a generally upper horizontal portion adapted to be removably and securely received by the arms 63 of the holding section 62 of the peg holder 28. Goods G with a little hanger or packaged goods G with a small hole in the package (see FIG. 1) can therefore be inserted onto the peg 30 via the free extremity 68 and slide along the support section 72 of the peg 30 to be hung or propped up for display for potential customers (shown on FIG. 1). Optionally, the peg 30 includes a tag rod 70 horizontally extending from the peg engaging extremity 64 and supporting a tag holder 66 at its front extremity essentially located just above said free extremity 68.

Figure 10A:
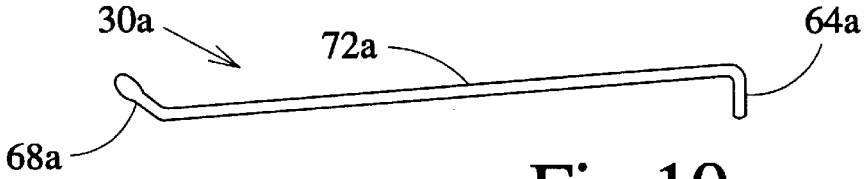

FIG. 10*a* shows a second type of a standard peg 30*a*. The peg 30*a* has similar elements 64*a*, 68*a* and 72*a* and characteristics to the peg 30 of FIG. 10, except for a noticeable difference at the peg engaging extremity 64*a*. The latter is essentially formed of a downwardly extending extremity of the support section 72*a* and adapted to be received within a vertically oriented bore hole of the holding section 62*a* of the peg holder 28*a* of FIGS. 7*a*, 8*a*, and 9*a*.

The materials used for each presented components of the multi peg adapter device 20 should be rigid enough to sustain the various holding forces required. Various alloys or strong, resilient thermoplastics can be considered.

Although the present multi peg adapter device has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

I claim:

1. A multi peg supporting adapter for supporting a generally elongated peg, said multi peg supporting adapter being mountable to an anchoring structure attached to a wall, said anchoring structure including attachment apertures formed therein, said peg defining a peg longitudinal axis, a peg first end and an opposed peg second end, said multi peg supporting adapter comprising:

a supporting bracket, said supporting bracket having a generally elongated configuration defining a bracket longitudinal axis, a bracket first end and a generally opposed bracket second end, said bracket first end being provided with a bracket releasable mounting means for releasably anchoring said bracket first end to said anchoring structure so that said bracket is cantilevered relative to said anchoring structure with said bracket second end positioned away from said anchoring structure;

a generally elongated supporting rod, said supporting rod defining a rod longitudinal axis, a rod first end and an opposed rod second end;

a rod-to-bracket releasable attachment means for releasably attaching said rod first end to said supporting bracket so that said rod longitudinal axis extends in a generally perpendicular relationship relative to said bracket longitudinal axis; said rod-to-bracket releasable attachment means allowing said rod first end to be attached to said supporting bracket at predetermined attachment locations positioned along said supporting bracket between said bracket first and second ends;

a peg-to-rod releasable attachment means for releasably attaching said peg first end to said supporting rod so that said peg longitudinal axis extends in a generally perpendicular relationship relative to said rod longitudinal axis, said peg-to-rod releasable attachment means allowing for said peg first end to be attached to said supporting rod at predetermined attachment locations positioned along said supporting rod between said rod first and second ends.

2. A multi peg supporting adapter as recited in claim 1 wherein said supporting rod has telescoping rod segments for allowing telescopic length adjustment of said supporting rod.

3. A multi peg supporting adapter as recited in claim 1 wherein said supporting bracket has a generally flat configuration defining a pair of opposed bracket surfaces, said bracket also defining a bracket attachment edge;

said rod-to-bracket releasable attachment means including at least two attachment notches spaced along said bracket attachment edge and an attachment leg extending from said rod first end, said attachment leg being configured and sized for being at least partially insertable into said attachment notches and retractable therefrom, wherein when said attachment leg is at least partially inserted into a corresponding attachment notch said attachment leg is also releasably secured thereto.

4. A multi peg supporting adapter as recited in claim 3 wherein each of said attachment notches defines a notch first edge extending inwardly and generally perpendicularly to said bracket attachment edge into said supporting bracket; each of said attachment notches also defining a notch second edge intercepting said notch first edge and extending in a direction generally parallel to bracket attachment edge; each of said attachment notches further defining a notch third edge, said notch third edge extending at an angle between said notch second edge and said bracket attachment edge.

5. A multi peg supporting adapter as recited in claim 4 wherein said attachment leg includes a leg spacing segment and a leg attachment segment, said leg spacing segment extending between said rod first end and said leg attachment segment; said leg attachment segment having a generally U-shaped cross-sectional configuration defining a pair of spaced apart abutment plates, said leg attachment segment being at least partially insertable into one of said attachment notches with each of said abutment plates abutting against a corresponding one of said bracket surfaces.

6. A multi peg supporting adapter as recited in claim 1 wherein said anchoring structure includes an anchoring pilaster attachable in a generally vertical orientation to said wall, said anchoring pilaster having a generally U-shaped cross-sectional configuration defining a pair of pilaster spacing segments maintained in a spaced apart and generally perpendicular relationship relative to each other by a pilaster anchoring segment, said attachment apertures having a generally slot-shaped configuration;

said bracket releasable mounting means including a bracket anchoring hook extending from said bracket first end, said bracket anchoring hook being provided for inserting and releasably anchoring into one of said attachment apertures.

7. A multi peg supporting adapter as recited in claim 1 wherein said anchoring structure includes pegboard attachable in a generally parallel relationship to said wall, said attachment apertures having a generally disk-shaped configuration;

said bracket releasable mounting means including a bracket-peg hook extending from said bracket first end, said bracket-peg hook being provided for inserting and releasably anchoring into one of said attachment apertures.

8. A multi peg supporting adapter as recited in claim 2 wherein said supporting rod includes a rod core and a rod sleeve slidably mounted thereon for telescopic movement relative thereto, said peg-to-rod releasable attachment means including at least two attachment rods attached to said supporting rod and extending in a direction generally parallel to the latter, said attachment rods being in a spaced apart relationship relative to each other so as to define an attachment rod spacing therebetween, said attachment rod spacing being configured and sized for releasably receiving an attachment section of said peg first end.

9. A multi peg supporting adapter as recited in claim 8 wherein said peg-torod releasable attachment means includes a stopper member attached to said attachment rods for preventing sliding movement of said peg relative to supporting rod along said longitudinal axis.

10. A multi peg supporting adapter for supporting a generally elongated peg, said multi peg supporting adapter being mountable to an anchoring structure attached to a wall, said anchoring structure including attachment apertures formed therein, said peg defining a peg longitudinal axis, a peg first end and an opposed peg second end, said multi peg supporting adapter comprising:

a supporting bracket, said supporting bracket having a generally elongated configuration defining a bracket longitudinal axis, a bracket first end and a generally opposed bracket second end, said bracket first end being provided with a bracket releasable mounting means for releasably anchoring said bracket first end to said anchoring structure so that said bracket is cantilevered relative to said anchoring structure with said bracket second end positioned away from said anchoring structure; said supporting bracket having a generally flat configuration defining a pair of opposed bracket surfaces, said bracket also defining a bracket attachment edge;

a generally elongated supporting rod, said supporting rod defining a rod longitudinal axis, a rod first end and an opposed rod second end;

a rod-to-bracket releasable attachment means for releasably attaching said rod first end to said supporting bracket so that said rod longitudinal axis extends in a generally perpendicular relationship relative to said bracket longitudinal axis; said rod-to-bracket releasable attachment means allowing said rod first end to be attached to said supporting bracket at predetermined attachment locations positioned along said supporting bracket between said bracket first and second ends, said rod-to-bracket releasable attachment means including at least two attachment notches spaced along said bracket attachment edge and an attachment leg extending from said rod first end, said attachment leg being configured and sized for being at least partially insertable into said attachment notches and retractable therefrom, wherein when said attachment leg is at least partially inserted into a corresponding attachment notch said attachment leg is also releasably secured thereto, each of said attachment notches defines a notch first edge extending inwardly and generally perpendicularly to said bracket attachment edge into said supporting bracket; each of said attachment notches also defining a notch second edge intercepting said notch first edge and extending in a direction generally parallel to bracket attachment edge; each of said attachment notches further defining a notch third edge, said notch third edge extending at an angle between said notch second edge and said bracket attachment edge, said attachment leg including a leg spacing segment and a leg attachment segment, said leg spacing segment extending between said rod first end and said leg attachment segment; said leg attachment segment having a generally U-shaped cross-sectional configuration defining a pair of spaced apart abutment plates, said leg attachment segment being at least partially insertable into one of said attachment notches with each of said abutment plates abutting against a corresponding one of said bracket surfaces;

a peg-to-rod releasable attachment means for releasably attaching said peg first end to said supporting rod so that said peg longitudinal axis extends in a generally perpendicular relationship relative to said rod longitudinal axis, said peg-to-rod releasable attachment means allowing for said peg first end to be attached to said supporting rod at predetermined attachment locations positioned along said supporting rod between said rod first and second ends;

said supporting rod having telescoping rod segments for allowing telescopic length adjustment of said supporting rod.

11. A multi peg supporting adapter as recited in claim 10 wherein said supporting rod includes a rod core and a rod sleeve slidably mounted thereon for telescopic movement relative thereto, said peg-to-rod releasable attachment means including at least two attachment rods attached to said supporting rod and extending in a direction generally parallel to the latter, said attachment rods being in a spaced apart relationship relative to each other so as to define an attachment rod spacing therebetween, said attachment rod spacing being configured and sized for releasably receiving an attachment section of said peg first end.

12. A multi peg supporting adapter as recited in claim 11 wherein said peg-to-rod releasable attachment means includes a stopper member attached to said attachment rods for preventing sliding movement of said peg relative to supporting rod along said longitudinal axis.

13. A multi peg supporting adapter for supporting a generally elongated peg, said multi peg supporting adapter being mountable to an anchoring structure attached to a wall, said anchoring structure including attachment apertures formed therein, said peg defining a peg longitudinal axis, a peg first end and an opposed peg second end, said multi peg supporting adapter comprising:

a pair of supporting brackets, each of said supporting brackets having a generally elongated configuration defining a bracket longitudinal axis, a bracket first end and a generally opposed bracket second end, said bracket first end being provided with a bracket releasable mounting means for releasably anchoring said bracket first end to said anchoring structure so that said bracket is cantilevered relative to said anchoring structure with said bracket second end positioned away from said anchoring structure;

a generally elongated supporting rod, said supporting rod defining a rod longitudinal axis, a rod first end and an opposed rod second end;

a rod-to-bracket releasable attachment means for releasably attaching said rod first and second ends to a corresponding one of said supporting brackets so that said rod longitudinal axis extends in a generally perpendicular relationship relative to said bracket longitudinal axis; said rod-to-bracket releasable attachment means allowing said rod first and second ends to be respectively attached to said corresponding one of said supporting brackets at predetermined attachment locations positioned along said supporting brackets between said bracket first and second ends;

a peg-to-rod releasable attachment means for releasably attaching said peg first end to said supporting rod so that said peg longitudinal axis extends in a generally perpendicular relationship relative to said rod longitudinal axis, said peg-to-rod releasable attachment means allowing for said peg first end to be attached to said supporting rod at predetermined attachment locations positioned along said supporting rod between said rod first and second ends.

14. A multi peg supporting adapter as recited in claim 13 wherein said supporting rod has telescoping rod segments for allowing telescopic length adjustment of said supporting rod.

15. A multi peg supporting adapter as recited in claim 13 wherein said supporting rod includes a rod core and a rod sleeve slidably mounted thereon for telescopic movement relative thereto, said peg-to-rod releasable attachment means including at least two attachment rods attached to said supporting rod and extending in a direction generally parallel to the latter, said attachment rods being in a spaced apart relationship relative to each other so as to define an attachment rod spacing therebetween, said attachment rod spacing being configured and sized for releasably receiving an attachment section of said peg first end.

* * * * *